US010441120B1

(12) United States Patent
Sgroi, Jr. et al.

(10) Patent No.: US 10,441,120 B1
(45) Date of Patent: Oct. 15, 2019

(54) UNIVERSAL CONNECTING MEMBERS

(75) Inventors: Anthony Sgroi, Jr., Wallingford, CT (US); David Quinlan, Plantsville, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 427 days.

(21) Appl. No.: 13/098,732

(22) Filed: May 2, 2011

Related U.S. Application Data

(60) Provisional application No. 61/329,822, filed on Apr. 30, 2010.

(51) Int. Cl.
*A47L 1/06* (2006.01)
*B25G 1/04* (2006.01)

(52) U.S. Cl.
CPC . *A47L 1/06* (2013.01); *B25G 1/04* (2013.01)

(58) Field of Classification Search
CPC ..... Y10T 403/32467; Y10T 403/32475; Y10T 403/32483; Y10T 403/59; Y10T 403/591; Y10T 403/595; A45C 13/26; A47L 1/06; B25G 1/04; E02F 3/3618; A46B 7/04; A46B 5/02; B64G 1/645; F16B 7/14; F16B 7/105
USPC .. 403/18, 109.1, 109.2, 109.3, 109.6, 109.8, 403/321, 322.1, 324, 377, 378, 379.5; 15/143.1, 145, 176.1, 176.6, 245, 245.1; 16/405, 429; 285/7, 319
See application file for complete search history.

(56) References Cited

U.S. PATENT DOCUMENTS

| | | | | |
|---|---|---|---|---|
| 62,057 | A * | 2/1867 | Nellis | 279/79 |
| 1,006,427 | A | 10/1911 | Boraks | |
| 2,184,881 | A | 12/1939 | Martinet | |
| 2,546,387 | A | 3/1951 | Coffing | |
| 2,660,457 | A | 11/1953 | Mallon | |
| 2,665,148 | A | 1/1954 | Humphrey et al. | |
| 2,755,106 | A | 7/1956 | Brennan et al. | |
| 2,832,612 | A | 4/1958 | Coutts | |
| 2,923,960 | A | 2/1960 | Davidson | |

(Continued)

FOREIGN PATENT DOCUMENTS

| | | |
|---|---|---|
| DE | 9207436 | 9/1992 |
| DE | 4240463 A1 | 6/1993 |

(Continued)

OTHER PUBLICATIONS

Supplementary European Search Report based on EP Patent Application No. 04812783.1 dated Feb. 14, 2008.

(Continued)

*Primary Examiner* — Amber R Anderson
*Assistant Examiner* — Nahid Amiri
(74) *Attorney, Agent, or Firm* — Cantor Colburn LLP

(57) ABSTRACT

Connecting members for the attachment of implements and handles are provided. The connecting member includes two inter-related flexure members that allow the selective locking and unlocking of the connecting member from an implement. The two flexure members are configured to work in combination so that each flexure member can contribute to a combined optimal biasing force. The combination of the two flexure members allows for the reduction of stress on each flexure member thereby resisting permanent deformation.

18 Claims, 7 Drawing Sheets

(56) References Cited

U.S. PATENT DOCUMENTS

| | | | | |
|---|---|---|---|---|
| 3,584,313 | A * | 6/1971 | Brown et al. | A62B 17/001 2/2.15 |
| 3,722,927 | A * | 3/1973 | Miska | 285/317 |
| 3,990,727 | A | 11/1976 | Gallagher | |
| 4,247,216 | A * | 1/1981 | Pansini | B25G 3/18 15/1.7 |
| 4,477,096 | A | 10/1984 | Wallace et al. | |
| 4,565,409 | A * | 1/1986 | Hollonbeck | A47C 16/00 297/411.1 |
| 4,632,436 | A | 12/1986 | Kimura | |
| 4,647,241 | A | 3/1987 | Weber | |
| 4,669,755 | A | 6/1987 | Harris et al. | |
| 4,766,638 | A | 8/1988 | McDowell | |
| 4,829,857 | A * | 5/1989 | Jones | 81/177.1 |
| 4,844,512 | A | 7/1989 | Gahwiler | |
| 5,186,341 | A | 2/1993 | Zeid | |
| 5,213,376 | A | 5/1993 | Szabo | |
| 5,374,088 | A | 12/1994 | Moretti et al. | |
| 5,400,870 | A * | 3/1995 | Inoue | 182/178.6 |
| 5,412,835 | A | 5/1995 | Vosbikian et al. | |
| 5,427,130 | A * | 6/1995 | Yang | 135/28 |
| 5,462,380 | A | 10/1995 | Peek et al. | |
| 5,471,701 | A * | 12/1995 | Parfenie | A46B 7/04 15/145 |
| 5,604,985 | A | 2/1997 | Andis et al. | |
| D386,063 | S | 11/1997 | Badiali | |
| 5,682,641 | A | 11/1997 | Newman et al. | |
| 5,704,658 | A | 1/1998 | Tozaki et al. | |
| 5,779,386 | A * | 7/1998 | Eichhorn | 403/329 |
| 5,899,481 | A | 5/1999 | Ferrarin | |
| 5,937,473 | A | 8/1999 | Lisowski | |
| 5,951,194 | A | 9/1999 | Faass et al. | |
| 6,082,922 | A * | 7/2000 | Cheng | A47D 13/063 403/102 |
| 6,115,881 | A | 9/2000 | Hult et al. | |
| 6,254,305 | B1 | 7/2001 | Taylor | |
| 6,311,368 | B1 | 11/2001 | Sartori | |
| 6,318,764 | B1 | 11/2001 | Trede et al. | |
| 6,370,730 | B1 | 4/2002 | Young et al. | |
| 6,461,074 | B2 | 10/2002 | Taylor | |
| 6,702,332 | B2 | 3/2004 | Young et al. | |
| 6,749,227 | B2 | 6/2004 | Margid | |
| 6,766,559 | B2 | 7/2004 | Roney et al. | |
| 6,886,865 | B2 | 5/2005 | Jung | |
| D525,511 | S | 7/2006 | Hung | |
| 7,219,386 | B2 * | 5/2007 | Tsuchiya et al. | 15/144.4 |
| D551,530 | S | 9/2007 | Hirsch | |
| 7,300,077 | B2 * | 11/2007 | Tawara et al. | 285/417 |
| 7,413,366 | B2 * | 8/2008 | Bensussan | 403/109.2 |
| 7,445,398 | B2 * | 11/2008 | Stockler | 403/109.3 |
| D588,767 | S | 3/2009 | Libman et al. | |
| D618,981 | S | 7/2010 | Gringer | |
| D634,087 | S | 3/2011 | Sgroi et al. | |
| 8,740,589 | B2 * | 6/2014 | Hess et al. | 417/437 |
| 8,851,345 | B2 * | 10/2014 | Ackeret | B60R 7/043 211/119.007 |
| 2002/0042969 | A1 | 4/2002 | Nagai et al. | |
| 2005/0050663 | A1 | 3/2005 | Goulet | |
| 2010/0054855 | A1 * | 3/2010 | Young | B25G 3/18 403/355 |

FOREIGN PATENT DOCUMENTS

| | | | |
|---|---|---|---|
| GB | 1566026 | A | 4/1980 |
| JP | 2005087508 | A | 4/2005 |
| SU | 679736 | | 8/1979 |
| WO | WO2010/0579690 | A3 * | 3/2010 |

OTHER PUBLICATIONS

International Search Report for PCT/US04/40340 dated Oct. 31, 2005.

* cited by examiner

FIG. 6A
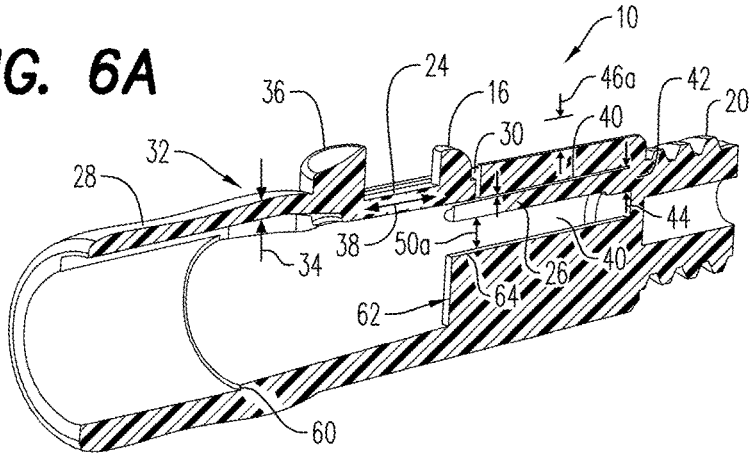
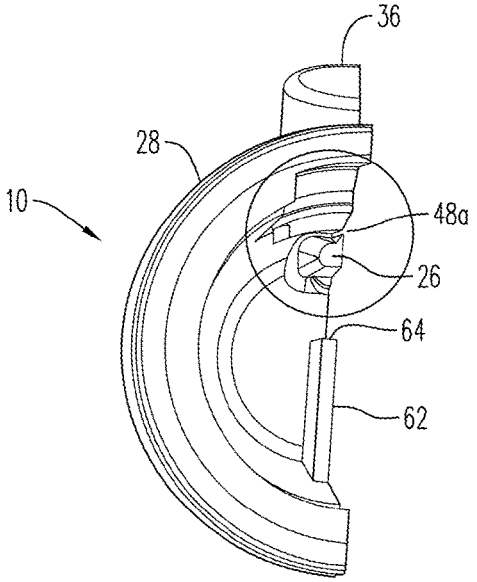
FIG. 7A
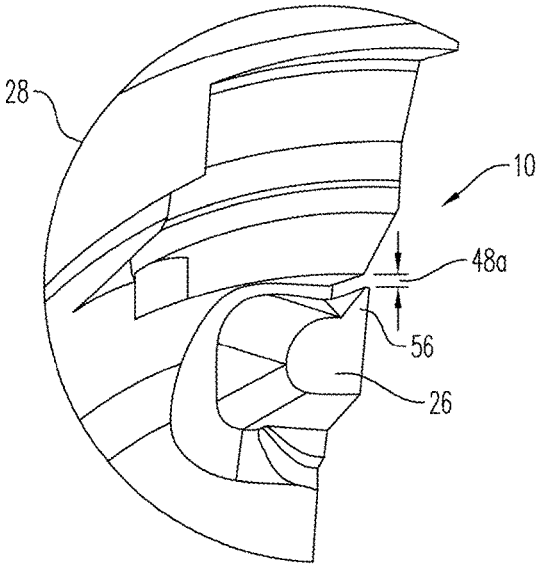
FIG. 7B

UNIVERSAL CONNECTING MEMBERS

CROSS REFERENCE TO RELATED APPLICATIONS

This application claims the benefit of U.S. Provisional Application Ser. No. 61/329,822, filed Apr. 30, 2010, the contents of which are incorporated by reference herein.

BACKGROUND OF THE INVENTION

1. Field of the Invention

The present disclosure is related to connecting members. More particularly, the present disclosure is related to universal connecting members for releasably connecting implements and handles.

2. Description of Related Art

Tools and related implements (hereinafter "implements") such as, but not limited to, brooms, brushes, squeegees, and the like are well known. In order to gain access to lower areas such as floors or higher areas such as ceilings, handles or extension poles (herein after "handles") have been made available that connect to the various implements.

More recently, there has been a desire for connecting members that allow the handle and implement to be connected to one another in a variety of different manners so that the handle can be used with various different implements and, the implement can be used with various different handles.

One such prior art connecting member is disclosed by Applicants' own U.S. Pat. No. 7,413,366, the contents of which are incorporated herein by reference. For example, Applicants' connecting member disclosed by '366 patent allows for a threaded connection, a press-fit connection, a locking-connection, and a combination of the press-fit and locking connections, which provide the connecting member with enhanced versatility.

Unfortunately, it has been determined by the present disclosure that the multiple components of prior art connecting members can increase the cost and complexity of design, the difficulty to manufacture, the difficulty to assemble, and the difficulty to use. Therefore, there is a need for connecting members that overcome, alleviate, and/or mitigate one or more of the aforementioned and other deleterious effects of the prior art.

BRIEF SUMMARY OF THE INVENTION

Connecting members for the attachment to implements and handles are provided. The connecting member includes two inter-related flexure members that allow the selective locking and unlocking of the connecting member from an implement. The two flexure members are configured to work in combination so that each flexure member can contribute to a combined optimal biasing force. The combination of the two flexure members allows for the reduction of stress on each flexure member thereby resisting permanent deformation. In some embodiments, the connecting member also includes a travel stop, which limits the range of motion of the two flexure members to prevent high stresses on the flexure members.

A connecting member for releasably securing an implement to a handle is provided. The member includes a body with a first connector and a locking connector. The first connector permanently or releasably secures the handle to the body. The locking connector is movable between a normal position to releasably secure the implement to the body and a fully depressed position that unsecures the implement from the body. The locking connector has a first flexure member and a second flexure member.

In some embodiments, the second flexure member, when the locking connector is in the normal position, is spaced a first distance from the first flexure member and is spaced a second distance from an inner surface of the body opposite the first flexure member.

In other embodiments, the first flexure member is formed in an outer wall of the body and has a first remaining wall, while the second flexure member is formed in an interior of the body and has a second remaining wall.

The first and second remaining walls can be formed facing opposite ends of the body so that the first and second flexure members extend in opposite directions to one another. Alternately, the first and second remaining walls can be formed facing the same end of the body so that the first and second flexure members extend in the same direction as one another.

The above-described and other features and advantages of the present disclosure will be appreciated and understood by those skilled in the art from the following detailed description, drawings, and appended claims.

BRIEF DESCRIPTION OF THE SEVERAL VIEWS OF THE DRAWINGS

FIG. 6*a* is a perspective sectional view of the connecting member of FIG. 4 shown in a normal or unstressed state, taken through line 6-6 of FIG. 5;

FIG. 7*a* is a sectional view of the connecting member of FIG. 1 taken through line 7-7 of FIG. 5;

FIG. 7*b* is an close up sectional view of FIG. 7*a;*

DETAILED DESCRIPTION OF THE INVENTION

Figure 1:
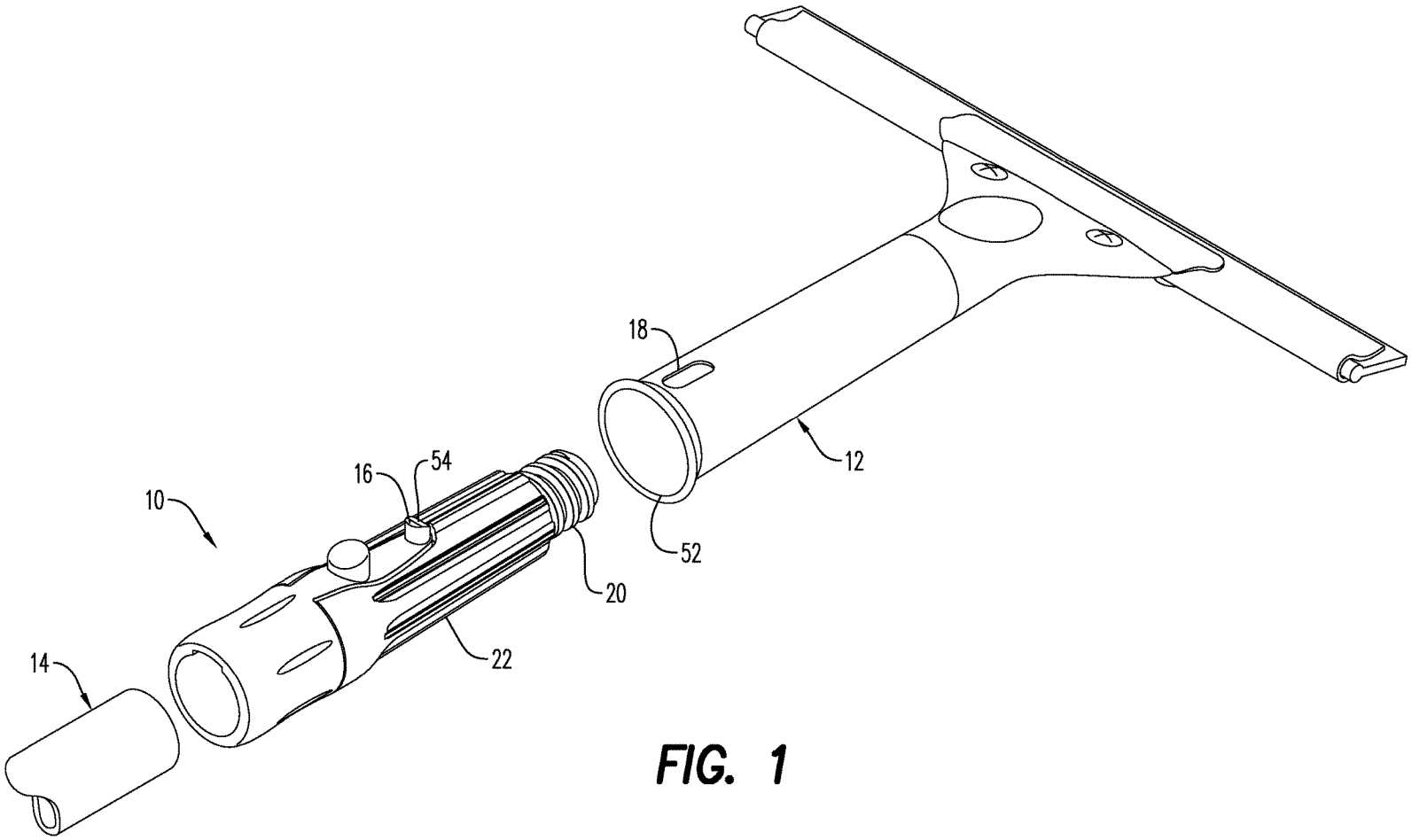
FIG. 1 is an exploded perspective view of an exemplary embodiment of a connecting member according to the present disclosure in use with a handle and an implement.
Figure 2:
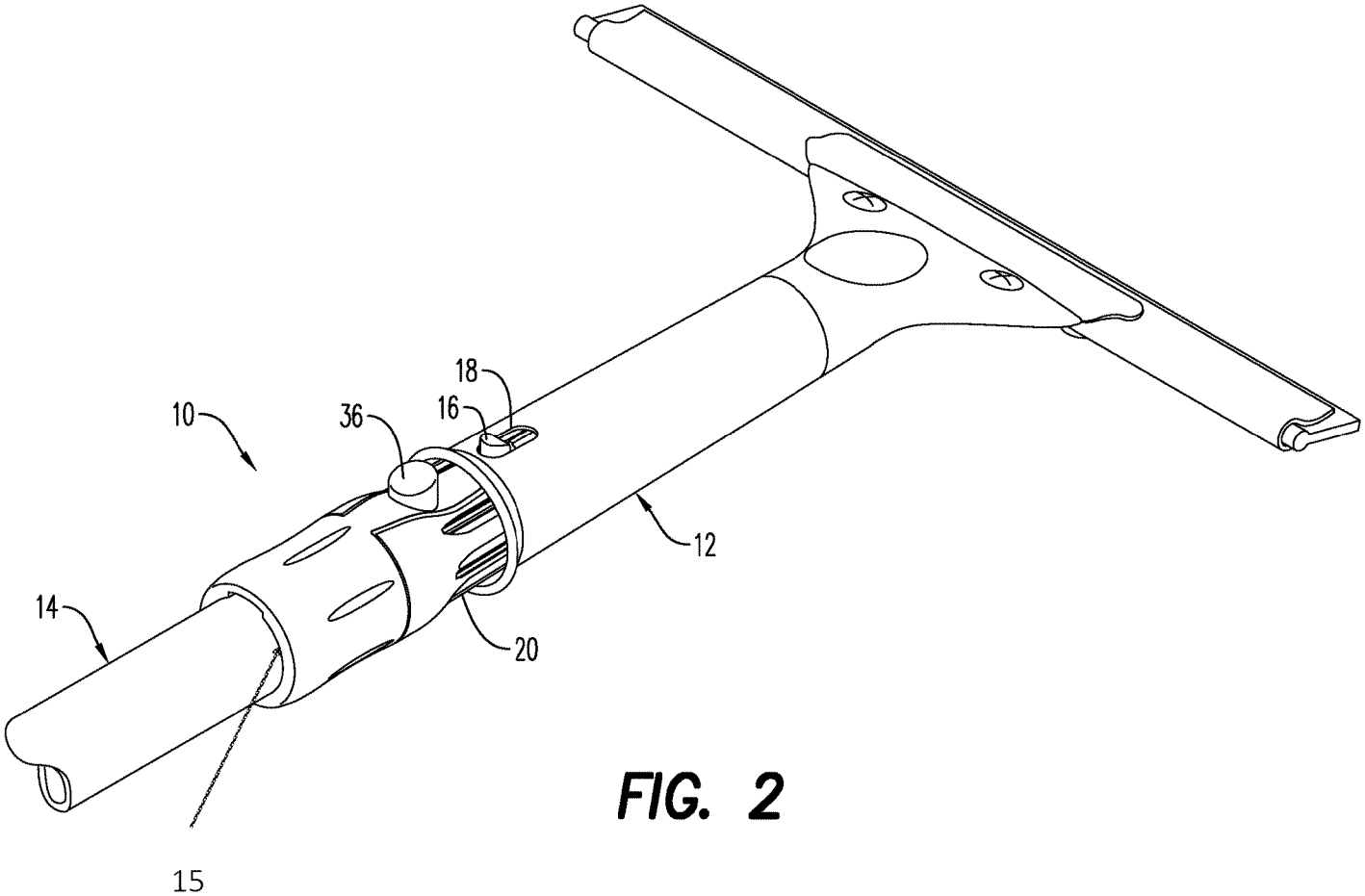
FIG. 2 is an assembled perspective view of the connecting member of FIG. 1.

Referring to the drawings and in particular to FIGS. 1 and 2, a connecting member according to an exemplary embodiment of the present disclosure is shown and is generally referred to by reference numeral 10.

Connecting member 10 is configured to releasably secure an implement 12 to a handle 14 by one of a number of different methods. Advantageously, and as described in more detail herein below, connecting member 10 has a simple design having at least two flexure members, which allow the connecting member enhanced versatility and enhanced longevity as compared to prior art devices. In some particularly advantageous embodiments, the at least two flexure members are integrally molded with connecting member 10 so that the connecting member provides a simple, one-piece construction. In other embodiments, the at least two flexure members are formed separately from but connected to connecting member 10.

Connecting member 10 can be permanently or releasably secured to handle 14 by a first connector 15 in any desired manner. In the illustrated embodiment, connecting member 10 is shown with first connector 15 forming a press-fit connection with handle 14. However, any desired method of permanently or releasably securing connecting member 10 to handle 14 are contemplated by the present disclosure.

Handle 14 can have any desired length or can have an adjustable length. Further, handle 14 can be made of any desired material sufficient to withstand the stresses imposed on the handle during use of implement 12. For example, handle 14 can be made of wood, plastic, metal, carbon fiber, fiberglass, or any combinations thereof.

As mentioned above, connecting member 10 is configured to releasably secure the implement 12 to the connecting member by at least one additional connector that uses any one of several different methods including a locking connection, a threaded connection, a press-fit connection, and a combination press-fit and locking connection.

For example, in order to releasably secure implement 12 to connecting member 10 using a locking connection, the connecting member includes a resiliently biased locking protrusion 16. Locking protrusion 16 can be in a normal state free of locking opening 18 of implement 12 as shown in FIG. 1. Alternately, locking protrusion 16 can be in its normal state received in locking opening 18 to secure the implement to connecting member 10 as shown in FIG. 2.

Alternately, in order to releasably secure implement 12 to connecting member 10 using a threaded connection as the at least one additional connector, the connecting member includes a threaded end 20. Threaded end 20 can be threadably engaged with a corresponding thread (not shown) on implement 12 in a known manner.

Further, in order to releasably secure implement 12 to connecting member 10 using the press-fit connection as the at least one additional connector, the connecting member includes a tapered or conical exterior surface 22. Exterior surface 22 can form a press-fit with an inner surface (not shown) of implement 12 in a known manner.

When releasably securing implement 12 to connecting member 10 using a combination of the press-fit and locking connections, locking protrusion 16 is received in locking opening 18 of implement 12 and conical exterior surface 22 forms a press-fit with the inner surface (not shown) of the implement.

Figure 3:
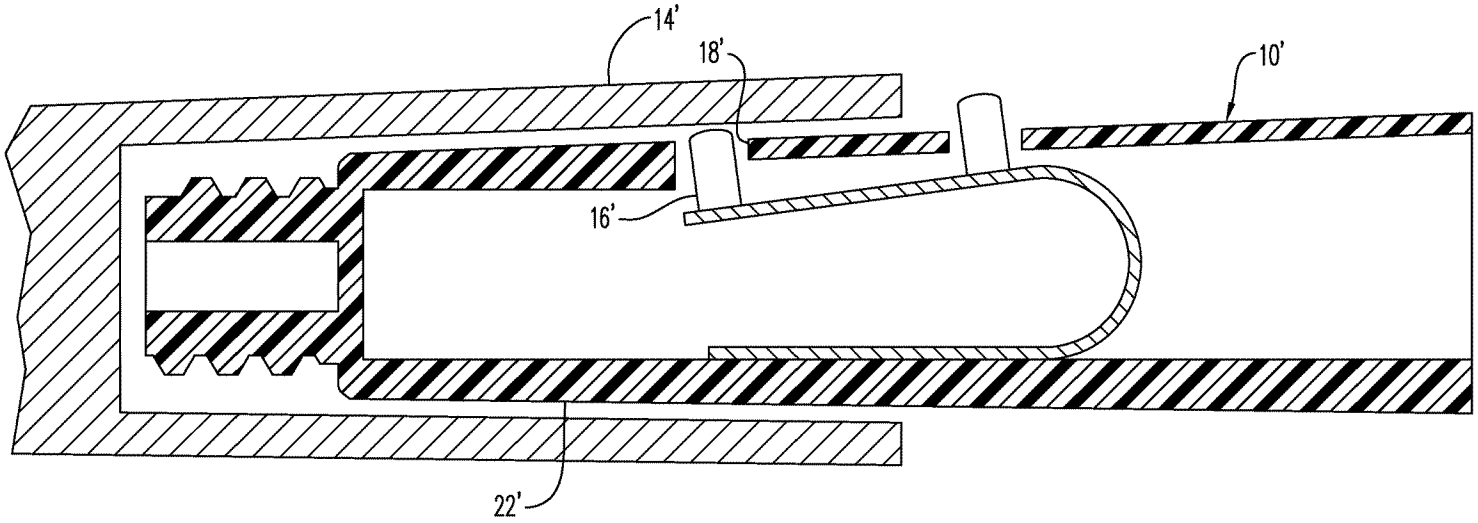
FIG. 3 (PRIOR ART)
FIG. 3 is an assembled perspective view of a prior art connecting member.

It has been determined by the present disclosure that the universality of connections provided by such connecting members can reduce the life and utility of prior art connecting members. For purposes of analysis, FIG. 3 illustrates a prior art connecting member 10'. When the exterior surface 22' of prior art connecting member 10' is used to form a press-fit connection with the inner surface of implement 12', the locking protrusion 16' remains in a flexed state. Locking protrusion 16' can remain in the flexed state due to at least two reasons. First, connecting member 10' may lack a locking opening that receives the locking protrusion 16' such that the locking protrusion remains flexed. Alternately, connecting member 10' may be improperly assembled so that locking protrusion 16' fails to extend through the locking opening such that the locking protrusion remains flexed.

Since some users store handle 14' and implement 12' in the assembled state for an extended period of time, the locking protrusion 16' remains in the flexed state during this extended period of time. Thus, it has been determined by the present disclosure that the localized stress applied to flex locking protrusion 16' can result in permanent deformation of the locking protrusion, in a manner known as relaxation or creep.

It has further been determined by the present disclosure that the permanent deformation effect in locking protrusion 16' can become even more pronounced when attempting to form the connecting member 10' of a single material and/or when attempting to form the locking member 16' as a integral, cantilevered beam.

Advantageously, connecting member 10 of the present disclosure includes two complimentary flexure members 24, 26, which help to mitigate the aforementioned effects of relaxation or creep of the prior art. Connecting member 10 is described in more detail with simultaneous reference to FIGS. 4 through 7.

Connecting member 10 includes a first flexure member 24 and a second flexure member 26. Locking protrusion 16 is formed on first flexure member 24. Advantageously, first and second flexure members 24, 26 cooperate so that locking protrusion 16 is maintained in a locked position at a predetermined locking force and stress when securing connecting member 10 to implement 12 using the locking connection.

Connecting member 10 further includes a releasing member 36 integrated on first flexure member 24. Releasing member 36 is longitudinally offset from locking protrusion 16 a predetermine distance 38 shown in FIG. 6*a*. Advantageously, distance 38 is selected to ensure that releasing member 36 is not obscured or covered by implement 12, when connecting member 10 is secured thereto. More specifically, when connecting member 10 is secured to implement 12 with locking protrusion 16 received in locking opening 18 as seen in FIG. 2, the implement does not cover or otherwise interfere with a user's access to releasing member 36. In this manner, the user can selectively move locking protrusion 16 into and out of locking opening 18 by applying pressure to releasing member 36.

First flexure member 24 is preferably integrally molded in body 28 of connecting member 10. First flexure member 24 is formed by a first cutout or relief 30 that extends through the wall of body 28 and around the sides of the first flexure member to form a first cantilever beam having one remaining wall 32.

Second flexure member 26 is also preferably integrally molded in body 28 of connecting member 10. Second flexure member 26 is formed by a second cutout or relief 40 that extends through body 28 and around the sides of the second flexure member to form a second cantilever beam having one remaining wall 42 shown in FIG. 6*a*.

Figure 6B:
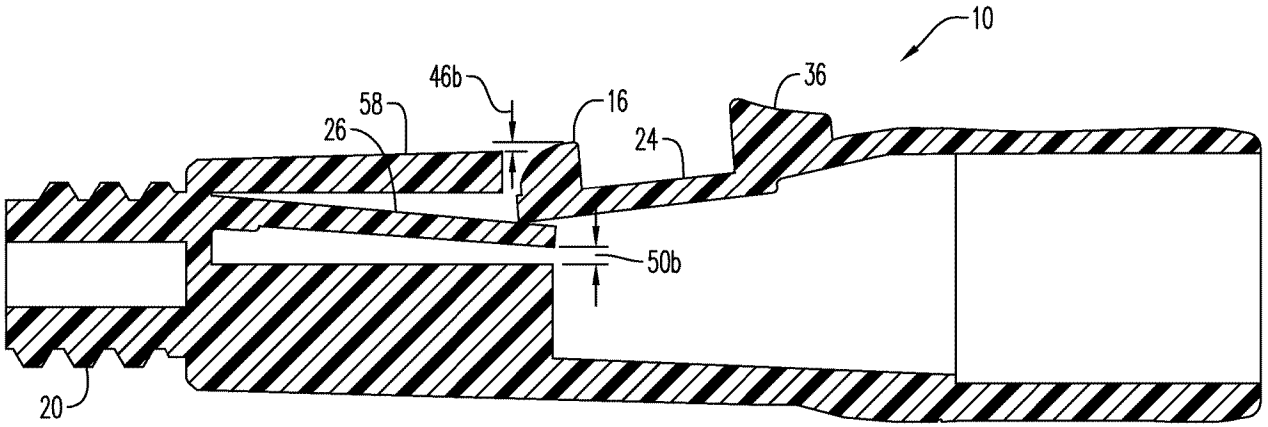
FIG. 6*b* is a sectional view of the connecting member of FIG. 6*a* shown in a partially depressed or stressed state.
Figure 6C:
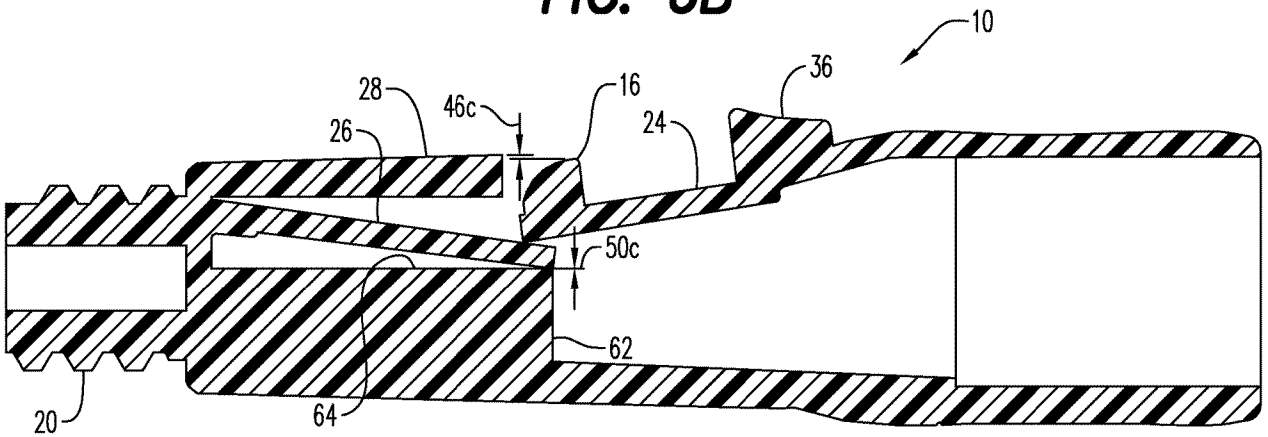
FIG. 6*c* is a sectional view of the connecting member of FIG. 6*a* shown in a fully depressed or stressed state.

First and second flexure members 24, 26 can be flexed or bent among a normal or unstressed state as in FIG. 6*a*, a partially depressed or stressed state as in FIG. 6*b*, and a fully depressed or stressed state as in FIG. 6*c*. Flexure members 24, 26 are formed of resilient materials that return the flexure members to the normal state upon the removal of the stresses on the flexure members.

As shown in FIG. 6*a*, first flexure member 24 flexes about a theoretical axis through remaining wall 32, which has a thickness 34, while second flexure member 26 flexes about a theoretical axis through remaining wall 42, which has a thickness 44. In the illustrated embodiment, remaining walls 32, 42 are formed at opposite ends of connecting member 10 so that first and second flexure members 24, 26 extend in opposite directions to one another. The stiffness and stress at defined displacements of first and second flexure members 24, 26 are related to material, shape (e.g., cross section), among other factors, thicknesses 34, 44, respectively.

In the normal or unstressed state illustrated in FIG. 6*a*, first flexing member 24 is defined by distance 46*a*. Distance 46*a* is defined between an uppermost extent of locking protrusion 16 and an outer surface of body 28. In this normal state, preferably second flexure member 26 is in close proximity to, but not in contact with, first flexure member 24. More specifically, second flexure member 26 is separated from first flexure member 24 via a distance 48*a*, which is defined by an inner dimension of body 28 and an outer dimension of the second flexure member. Additionally, second flexure member 26 is spaced from an inner surface of body 28 via a distance 50*a*, which is defined by another inner dimension of body 28 and another outer dimension of the second flexure member.

It should be recognized that connecting member 10 is described above by way of example only as having, in the normal state, second flexure member 26 is in close proximity to, but not in contact with, first flexure member 24. Of course, it is contemplated by the present disclosure for first and second flexure members 24, 26 to be in contact with one another, including embodiments where the second flexure member provides the first flexure member with a predetermined amount of preload. The contact between first and second flexure members 24, 26, can be provided in any desired manner such as, but not limited to, being molded no in contact with one another but subjected to a post molding physical operations or being exposed to post molding uneven cooling operations.

Stated another way, distance 48*a* is defined as the dimension of second cutout or relief 40. Distances 48*a*, 50*a* are maintained when connecting member 10 is in its normal state or unstressed state as defined by distance 46*a*.

First and second flexure members 24, 26 can be displaced from the normal or unstressed state (FIG. 6*a*) to the partially depressed state (FIG. 6*b*) or the fully depressed state (FIG. 6*c*) by one or more actions.

The first action occurs through direct contact between locking protrusion 16 and implement 12. Specifically, implement 12 can include a beveled or ramped surface 52 that, during insertion of connecting member 10 into the implement, contacts a beveled or ramped surface 54 of locking protrusion 16 shown in FIG. 1. The interaction of surfaces 52, 54, when sufficient insertion force is applied, results in flexion of first and second flexure members 24, 26 from the normal state of FIG. 6*a* to the partially and/or fully depressed states of FIGS. 6*b* and 6*c*.

The second action occurs through pressure applied by a user on releasing member 36. The user applied pressure on releasing member 36, when sufficient force is applied, results in flexion of first and second flexure members 24, 26 from the normal state of FIG. 6*a* to the partially and/or fully depressed states of FIGS. 6*b* and 6*c*.

Of course, it should be noted that the displacing of first and second flexure members 24, 26 can result by the combination of the two aforementioned or other actions.

Second flexure member 26 is displaced by direct contact of first flexure member 24 on the second flexure member. As best illustrated in FIG. 6, first and second flexure members 24, 26 are separated from one another in the normal state by distance 48*a*. When first flexure member 24 is displaced from the normal state, distance 48*a* approaches zero until contact between the first and second flexure members is established. As first flexure member 24 is displaced past the point where distance 48*a* reaches zero, the first flexure member applies pressure on the second flexure member 26 to flex the second flexure member 28 such that distance 50*a* is reduced from its normal state of FIG. 6*a*, to distance 50*b* in the partially depressed state of FIG. 6*b*, or to distance 50*c* in the fully depressed state of FIG. 6*c*. In the fully depressed state of FIG. 6*c*, distance 50*c*is zero such that the second flexure member 26 contacts the inner dimension of body 28.

In the partially depressed state of FIG. 6*b*, first flexing member 24 is at a position illustrated distance 46*b*, which is defined between an uppermost extent of locking protrusion 16 and the outer surface of body 28. Similarly, in the fully depressed state of FIG. 6*c*, first flexing member 24 is at a position illustrated distance 46*c*, which is defined between an uppermost extent of locking protrusion 16 and the outer surface of body 28.

The first portion of travel of first flexure member 24, namely from the normal position of FIG. 6*a* having dimension 48*a* greater than zero to a position where first flexure member 24 contacts second flexure member 26 (dimension 48*a* equal to zero), is not aided by second flexure member 26. The resultant travel of locking member 16 in this first portion of travel is not sufficient to move the locking member to the point where the locking member is free from locking opening 18. Thus, connecting member 10 cannot be removed from implement 12 merely by the movement of first flexure member 24, but also requires the movement of second flexure member.

It has been determined by the present disclosure that optimal values of locking forces attributed by first and second flexure members 24, 26 are desirable. When low force values are present, inadvertent release of implement 12 from connecting member 10 may occur. Such occurrences could result when implement 12 is subjected to shocks or sudden accelerations. In contrast, when high levels of locking forces are present due to the interaction of first and second flexure members 24, 26, implement 12 is advantageously prevented from being inadvertently removed from connecting member 10.

If the removal forces contributed by first and second flexure members 24, 26 is too high, the user may have difficulty during securing connecting member 10 and implement 12 to one another.

Without wishing to be bound by any particular theory, the optimal locking force is defined to be such a locking force that ordinary users can assemble and remove implement 12 from connecting member 10 without difficulty, and during use, the implement remains secured to the connecting member without inadvertent removal.

Accordingly, it has been determined by the present disclosure that the combination of first and second flexure members 24, 26 allows for several advantages. In the example provided, connecting member 10 can be fabricated with first and second flexure members 24, 26 in a single component. The second advantage provides the distribution or sharing of the locking force for locking protrusion 16 by first and second flexure members 24, 26. When the forces are shared by first and second flexure members 24, 26, it has been determined by the present disclosure that it is possible to reduce the operational levels of stress for each flexure member and still provide the optimal locking force for locking protrusion 16.

Advantageously, it has been determined that the dual flexure member arrangement of connecting member 10 reduces permanent deformation which would lower the locking force necessary to deflect locking protrusion 16 from the normal state. In addition, the dual flexure member arrangement of connecting member 10 also reduces first and second flexure members 24, 26 from relaxing or creep if subjected to displacements for elevated levels of time and temperature.

In the example provided, connecting member 10 is fabricated out a resilient material so that first and second flexure members 24, 26 can have resilient or spring like properties. Such materials include and are not limited to thermoplastics, thermoset plastics, hard rubbers, among others. One having ordinary skill in the art can recognize that connecting member 10 can be fabricated using several methods, such methods include and are not limited to injection molding, urethane casting, etc. One having ordinary skill in the art can also appreciate that first and second flexure members 24, 26 can be fabricated as separate resilient components and joined to connecting member 10. This option would allow for the choice of other materials and/or other process methods for the fabrication of connecting member 10. Such joining methods may include screwing, press fits, welding, among others.

As detailed in FIGS. 7*a* and 7*b*, second flexure member 26 is configured as a tapered beam to allow for injection molding, where the taper allows for optimal cavity forming surfaces. To mitigate mold wear and provide minimal values for distance 48*a*, the distance 48*a* is formed between the inner surface of body 28 and a contact portion 56 of second flexure member 26.

Figure 4:
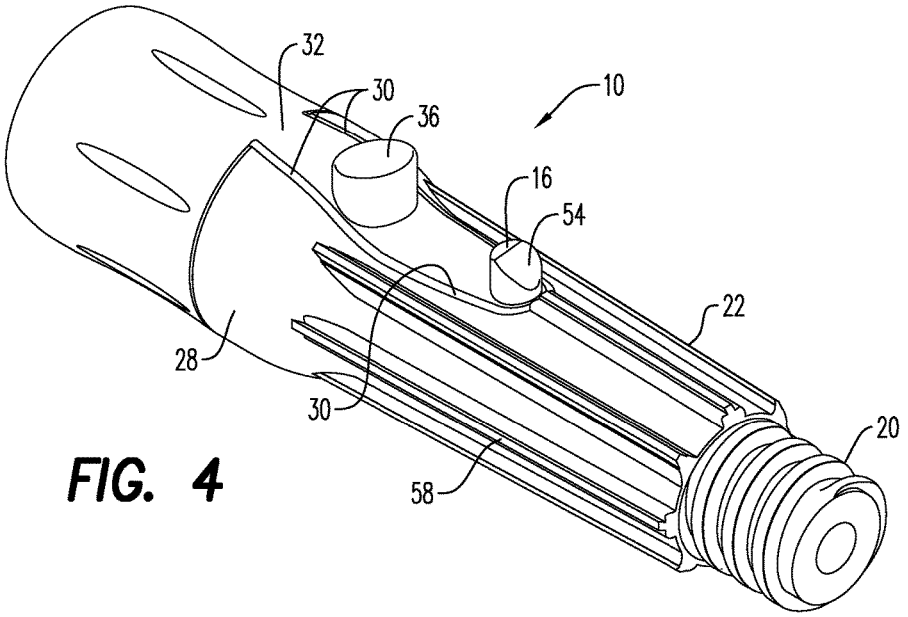
FIG. 4 is a front, top perspective view of the connecting member of FIG. 1.
Figure 5:
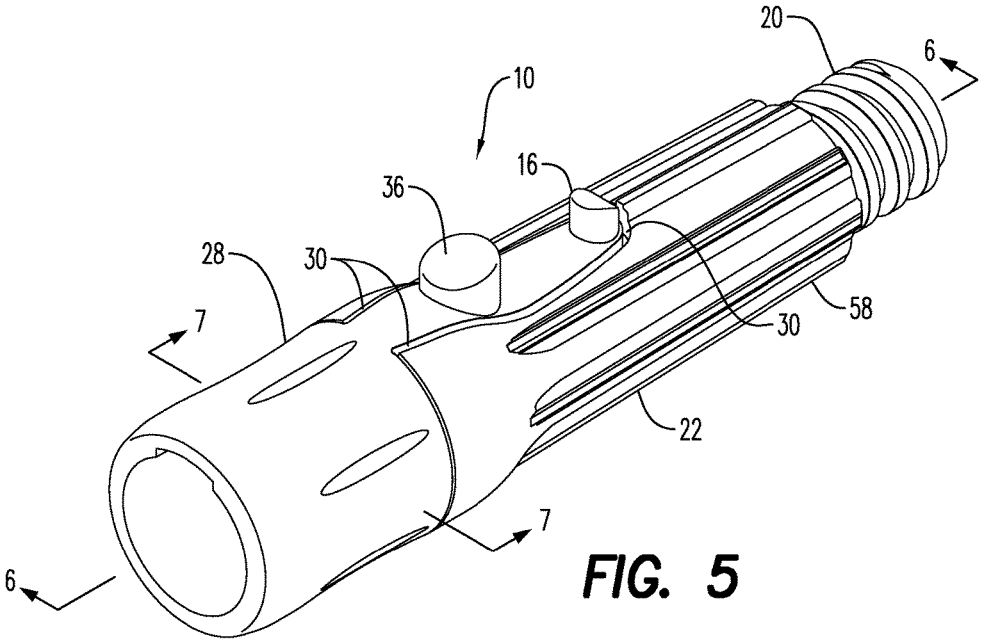
FIG. 5 is a rear, top perspective view of a connecting member of FIG. 1.

In some embodiments, tapered or conical exterior surface 22 of connecting member 10 can be formed by a plurality of rib members 58 as seen in FIGS. 4 and 5.

In other embodiments, where connecting member 10 finds use forming a press-fit connection with handle 14, the inner dimension of the connecting member can include a stop 60, which control the insertion distance of the press-fit, as seen in FIG. 6*a*.

In still other embodiments, connecting member 10 can include a travel stop 62 integrally molded within body 28 as seen in FIG. 6*c*. Travel stop 62 includes an upper surface 64 facing first and second flexure members 24, 26, where the upper surface interferes with the first and/or second flexure member to limit the travel of the flexure members. In this manner, travel stop 62 can prevent a user from inadvertently moving first and/or second flexure members 24, 26 beyond a predetermined travel, which can further reduce the stresses induced in the flexure members. The predetermined travel is defined as distance 50*a*.

Figure 8:
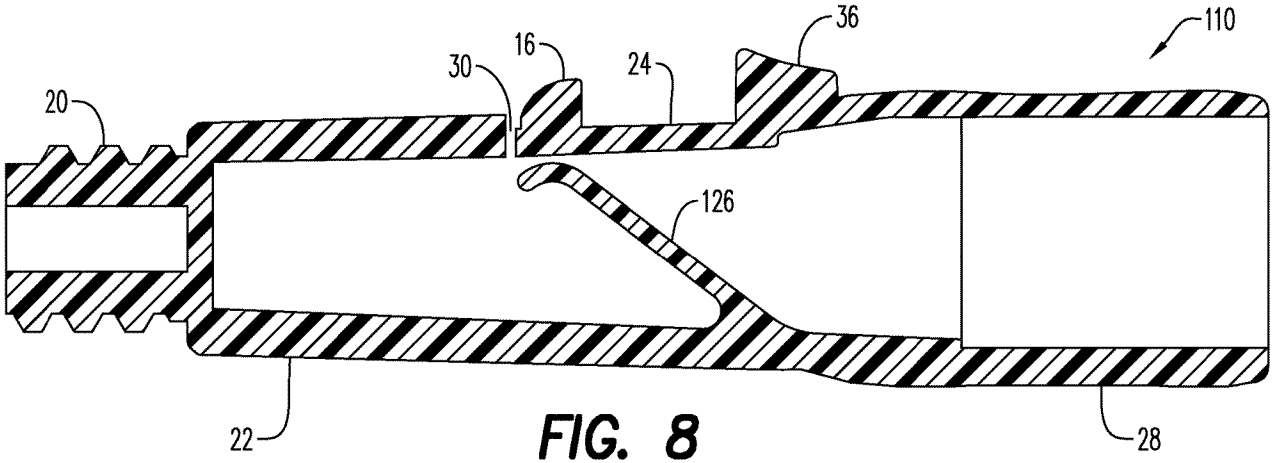
FIG. 8 is a sectional view of a second exemplary embodiment of a connecting member according to the present disclosure.

Referring now to FIG. 8, an alternate exemplary embodiment of a connecting member according to the present disclosure is shown. Here, component parts performing similar and/or analogous functions are labeled in multiples of one hundred. Thus, the connecting member is generally referred to by reference numeral 110.

Connecting member 110, similar to connecting member 10 discussed in detail above, includes locking protrusion 16, threaded end 20, conical or tapered exterior surface 22, and first flexure member 24. Additionally, connecting member 110 includes a second flexure member 126 that has a curved beam section and extends substantially in the same direction as first flexure member 24.

Second flexure member 126 can be integral to connecting member 110 as shown in FIG. 8. Thus, second flexure member 126 can be formed from the same material as connecting member 110 or can be co-molded from different materials then remaining portions of the connecting member.

Alternatively, second flexure member 126 can be fabricated as a separate component and assembled to connecting member 110. Thus, second flexure member 126 can be fabricated in any desired material including and not limited to plastic, metal, or any other desired material.

It should be recognized that second flexure member 126 is described above as a curved beam section by way of example only. Of course, it is contemplated by the present disclosure for second flexure member 126 to have any desired shape sufficient to work in combination with first flexure member 24 to contribute to a combined optimal force. For example, it is contemplated by the present disclosure for second flexure member 126 to include straight beam sections, elliptical beam sections, and any combinations thereof.

Figure 9:
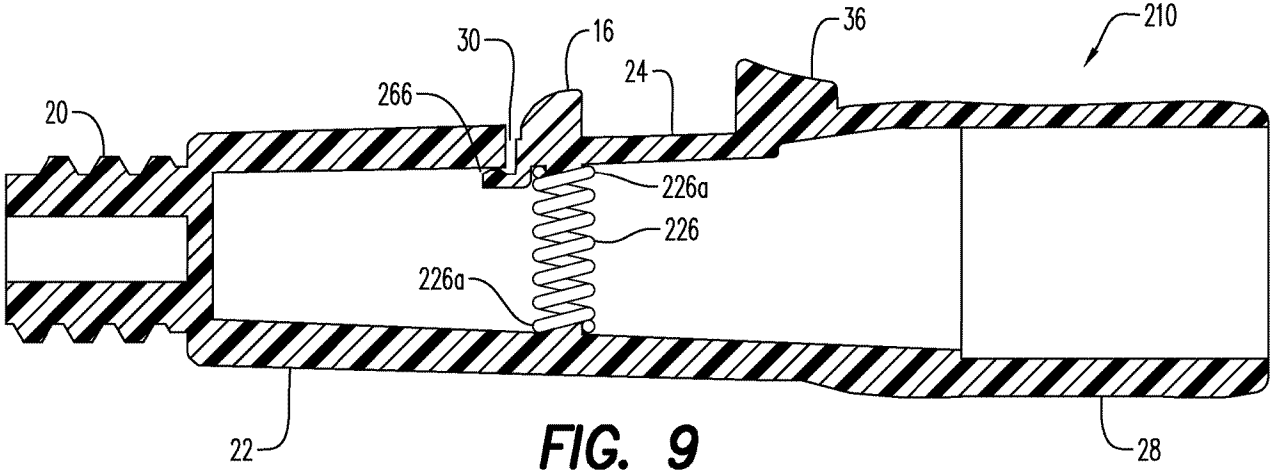
FIG. 9 is a sectional view of a third exemplary embodiment of a connecting member according to the present disclosure.

Referring now to FIG. 9, another alternate exemplary embodiment of a connecting member according to the present disclosure is shown. Here, component parts performing similar and/or analogous functions are labeled in multiples of two hundred. Thus, the connecting member is generally referred to by reference numeral 210.

Connecting member 210, similar to connecting members 10 and 110 discussed in detail above, includes locking protrusion 16, threaded end 20, conical or tapered exterior surface 22, and first flexure member 24. Additionally, connecting member 210 includes a second flexure member 226 that is fabricated as a separate component and assembled to connecting member 210.

In the illustrated embodiment, second flexure member 226 is a coiled compression spring fabricated using spring steel and connected to connecting member 210 by way of integrally molded retaining posts 226*a*. In some embodiments, one or both of retaining posts 226*a* can act as a travel stop, which limits the total travel of first and second flexure members 24, 226.

In other embodiments, connecting member 210 can include a second travel stop 266, which prevents second flexure member 226 from biasing first flexure member 24 upward beyond the normal position illustrated in FIG. 9. Second travel stop 266 can be formed on body 28, on first flexure member 24, or any combination thereof.

Of course, it is contemplated by the present disclosure for second flexure member 226 to can be fabricated in any desired material including and not limited to plastic, metal, foam, or any other resilient material and/or it is contemplated by the present disclosure for the second flexure member to have any desired configuration such as, but not limited to, a leaf spring, an S-spring, and others.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. In addition, combinations of the different features can be combined to create different products. Therefore, it is intended that the present disclosure not be limited to the particular embodiment(s) disclosed as the best mode contemplated, but that the disclosure will include all embodiments falling within the scope of the present disclosure.

What is claimed is:

1. A connecting member for releasably securing an implement, comprising:

a body;

a handle locking connector on the body to secure said body to a handle; and an implement locking connector on the body, said implement locking connector being movable among a normal position releasably securing the implement to said body, a partially depressed position, and a fully depressed position unsecuring the implement from said body, said implement locking connector comprising a first flexure member and a second flexure member, wherein only said first flexure member flexes in said partially depressed position, and wherein said first flexure member flexes said second flexure member in said fully depressed position.

2. The connecting member of claim 1, wherein said second flexure member, when said implement locking connector is in said normal position, is spaced a first distance from said first flexure member.

3. The connecting member of claim 2, wherein said second flexure member, when said implement locking connector is in said normal position, is spaced a second distance from an inner surface of said body opposite said first flexure member.

4. The connecting member of claim 2, wherein said second flexure member, when said implement locking connector is moved past said first distance, is displaced by direct contact of said first flexure member on said second flexure member.

5. The connecting member of claim 3, wherein said first flexure member has a first portion of travel equal to said first distance before said first flexure member contacts said second flexure member.

6. The connecting member of claim 3, wherein said second flexure member, when said implement locking connector is in said fully depressed position, is displaced said second distance such that said inner surface acts as a travel stop.

7. The connecting member of claim 5, wherein said first portion of travel is not sufficient to allow said body to be removed from the implement merely by movement of said first flexure member.

8. The connecting member of claim 1, further comprising a locking protrusion formed on said first flexure member, said locking protrusion being configured to mate with the implement when in said normal position and being configured to not mate with the implement when in said fully depressed position.

9. The connecting member of claim 8, wherein said first flexure member further comprises a releasing member integrated thereon, said releasing member being longitudinally offset from said locking protrusion a distance sufficient to ensure that said releasing member is not obscured or covered by the implement when said locking protrusion is mated with the implement.

10. The connecting member of claim 1, wherein said first and second flexure members are integrally molded with said body.

11. The connecting member of claim 1, further comprising at least one additional implement locking connector for releasably securing the implement to said body.

12. The connecting member of claim 11, wherein said at least one additional implement locking connector comprises a connector selected from the group consisting of a threaded connection and a press-fit connection.

13. A connecting member for releasably securing an implement, comprising:

a body; and an implement locking connector on the body, said implement locking connector being movable among a normal position releasably securing the implement to said body, a partially depressed position, and a fully depressed position unsecuring the implement from said body, said implement locking connector comprising a first flexure member and a second flexure member, said first and second flexure members contacting one another in at least said partially depressed position, wherein said first flexure member is formed by a first cutout or relief that extends through an outer wall of said body and around sides of said first flexure member to form a first cantilever beam having a first remaining wall, and wherein said second flexure member is formed in an interior of said body by a second cutout or relief that extends through said body and around sides of said second flexure member to form a second cantilever beam having a second remaining wall.

14. The connecting member of claim 13, wherein said first and second remaining walls are formed facing opposite ends of said body so that said first and second flexure members extend in opposite directions to one another.

15. A connecting member for releasably securing an implement, comprising:

a body; and an implement locking connector on the body, said implement locking connector being movable between a normal position releasably securing the implement to said body and a fully depressed position unsecuring the implement from said body, said implement locking connector comprising a first flexure member and a second flexure member, said first flexure member being formed by a first cutout or relief that extends through an outer wall of said body and around sides of said first flexure member to form a first cantilever beam having a first remaining wall, said second flexure member being formed in an interior of said body by a second cutout or relief that extends through said body and around sides of said second flexure member to form a second cantilever beam having a second remaining wall.

16. The connecting member of claim 15, further comprising a handle locking connector on the body to secure said body to a handle.

17. The connecting member of claim 15, wherein said second flexure member, when said implement locking connector is in said normal position, is spaced a first distance from said first flexure member and is spaced a second distance from an inner surface of said body opposite said first flexure member.

18. A connecting member for releasably securing an implement, comprising:

a body; and an implement locking connector on the body, said implement locking connector being movable between a normal position releasably securing the implement to said body and a fully depressed position unsecuring the implement from said body, said implement locking connector comprising a first flexure member and a second flexure member, said first flexure member being formed by a first cutout or relief that extends through an outer wall of said body and around sides of said first flexure member to form a first cantilever beam having a first remaining wall, said second flexure member being formed in an interior of said body by a second cutout or relief that extends through said body and around sides of said second flexure member to form a second cantilever beam having a second remaining wall, wherein said first and second remaining walls are formed facing opposite ends of said body so that said first and second flexure members extend in opposite directions to one another.

* * * * *